United States Patent [19]

Coltrin et al.

[11] Patent Number: 5,022,690

[45] Date of Patent: Jun. 11, 1991

[54] QUICK RELEASE LATCH MECHANISM

[75] Inventors: George E. Coltrin, Rowland Heights; Siamak Ilami, Santa Ana, both of Calif.

[73] Assignee: Adams & Coltrin, Inc., City of Industry, Calif.

[21] Appl. No.: 408,687

[22] Filed: Sep. 18, 1989

[51] Int. Cl.[5] ..... E05C 1/14

[52] U.S. Cl. ..... 292/21; 49/56; 292/252

[58] Field of Search ..... 292/252, 21; 403/328, 403/327, DIG. 6; 49/56, 57

[56] References Cited

U.S. PATENT DOCUMENTS

| | | | |
|---|---|---|---|
| 1,472,242 | 10/1923 | Covi | 292/59 |
| 3,764,172 | 10/1973 | Standke | 292/252 X |
| 4,111,477 | 9/1978 | Rigali | 292/252 |
| 4,263,747 | 4/1981 | Coltrin et al. | 49/56 |
| 4,647,090 | 3/1987 | Jones | 292/DIG. 66 X |
| 4,856,229 | 8/1989 | Tserng | 292/252 X |

*Primary Examiner*—Richard E. Moore

*Attorney, Agent, or Firm*—Boniard I. Brown

[57] ABSTRACT

An emergency release latch for releasibly locking a protective closure, such as a window grill, in closed position over an opening in a building structure to prevent intruders from entering the structure through the opening and yet permit escape of persons from the structure through the opening in the event of a fire or other emergency. The latch is relativey immune to improper installation and tampering, releases automatically in response to a fire in the immediate vicinity of the escape opening and in response to breaking of the latch actuator, is reliable in operation over long periods of time without servicing, is easily releasible by young, handicapped, and elderly persons, and is secure against forced entry when engaged.

27 Claims, 2 Drawing Sheets

20
22
2
7
28
38
46
30
48
26
24
34
32
42
36
44
37
6
40
150
148
3
66
72
64
152
144
142
132
130
124
136
54
11
52
140
138
137
128
4

QUICK RELEASE LATCH MECHANISM

BACKGROUND OF THE INVENTION

1. Field of the Invention

This invention relates generally to latching devices and more particularly to an improved quick release latch for emergency escape applications and other uses.

2. Prior Art

As will become evident from the ensuing description, the improved latch of the invention may be used for a variety of purposes. The improved latch is particularly designed, however, for use as an emergency escape latch for protective window grills and the like. For this reason, the invention will be described in this particular context.

It is becoming ever increasingly necessary to protect building structures against unauthorized entry through windows and other openings and yet permit escape of persons from the structures through such openings in the event of a fire, gas leak, or other emergency. Decorative wrought iron window grills have long been used to provide protection against unauthorized entry through windows and the like. Many window grills were and still are permanently attached to the structures. As a result, persons were and still are often trapped and die in such structures during a fire because of the inability to release or open the window grills. For this reason most if not all city codes now require structures protected by window grills or the like to be provided with quick release window grill latches which can be quickly and easily released by persons within the structures to permit escape of the persons through the windows.

A wide variety of latches for this purpose have been devised. Examples of such latches and other similar latches are described in the following U.S. Pat. Nos.: 2,715,583, 4,019,281, 4,055,360, 4,057,935, 4,070,048, 4,127,966, 4,263,747.

City codes governing protective window grills and latches generally set forth certain specific requirements for such latches. The ideal window grill latch will also satisfy certain other requirements. Foremost among these legal and ideal requirements are the following:

1. The window grill must be capable of being quickly and easily opened in the event of an emergency and at other times securely latched closed in a manner which provides the grill with a high resistance to forced entry by an intruder.

2. The window grill and its latch must be highly reliable in operation so as to assure easy opening of the grill in the event of an emergency.

3. The grill latch must be readily accessible to and easily operable by all potential users, including the young, elderly, and disabled, and its operation must be obvious without reading detailed instructions.

4. The grill latch must be immune to improper installation and to tampering, particularly by children which would cause malfunctioning of either or both the latch and window grill.

5. The grill latch must be immune to corrosion and other deterioration which would degrade the latch components or latch operation.

6. The grill latch should be automatically selflatching in order to encourage escape practice.

7. The window grill should open automatically in response to a fire near the window to permit rescuers to enter through the window even though the window grill latch cannot be released by persons in the burning structure.

8. The window grill latch should be capable of relatively low cost, high precision manufacture and easy to install.

SUMMARY OF THE INVENTION

This invention provides an improved closure latch and an improved latch and closure combination which are uniquely adapted for the protective window grill application discussed above and satisfy the above and other requirements of such a latch and latch/window grill combination. For this reason, the invention will be described in the context of this particular application, although it will become apparent as the description proceeds that the improvements of the invention may be utilized for other purposes. In this context, the improved latch and latch/closure combination of the invention are characterized by (a) high resistance to forced entry, (b) high reliability of operation over prolonged periods without servicing, (c) immunity to improper installation, (d) high resistance to tampering, particularly by children, (e) immunity to corrosion and other environmentally produced effects which would tend to degrade operational reliability, (f) ease of operation to encourage escape practice without the danger of improper locking of the latch, and (g) automatic release in response to a fire.

The improved latch of the invention comprises two parts having engaged and disengaged positions relative to one another, and coacting latch means on the latch parts for releasibly locking the parts to one another and against disengagement when the parts occupy their engaged positions. In use, one latch part is mounted on a structure having an opening which, in this disclosure, is assumed to be and is hereafter referred to as a window, and the other latch part is mounted on a closure which, in this disclosure, is assumed to be and is hereafter referred to as a protective window grill, or simply a grill, that is movable between open and closed positions relative to the window. The parts are automatically engaged and locked by closing the grill and disengaged by opening the grill when the latch is released. When its parts are engaged and properly locked to one another with the window grill closed, the latch provides a quick release emergency escape latch system which securely locks the grill in its closed position to prevent entry by intruders and is quickly and easily releasible in the case of a fire or other emergency to release the grill for opening.

According to one feature of the invention, the latch is made relatively immune to improper installation. To this end, the coacting latch means on the latch parts include a latch member on one part which normally occupies a central locking position wherein the parts are locked against disengagement to lock the window grill closed and is movable in opposite directions from this locking position to first and second unlocking positions, respectively, wherein the latch parts are released for disengagement to release the grill for opening. This latch member is connected by a tension member such as a cable to a latch actuator accessible within the protected structure for operation by persons in the structure to move the latch member to one unlocking position and thereby release the grill for opening. The latch is arranged so that the latch member will normally occupy its central locking position to lock the window grill closed only if the lock is properly installed. If the latch is not properly installed, the latch member will normally occupy one or the other of its unlocking positions and the grill will not lock closed, thus indicating improper latch installation.

According to another feature of the invention, the latch parts are automatically released for disengagement in response to a fire in the vicinity of the latch and in response to breaking of the cable connecting the latch member and the latch actuator within the protected structure. To this end, the latch member is spring biased toward its first unlocking position and is connected to the actuator by a cable and a temperature responsive means, preferably a fusible link in such a way that the latch member is normally held in its central locking position against the thrust of the latch member biasing spring. The latch member is manually movable to its second unlocking position against the thrust of the biasing spring by operation of the latch actuator. The latch member is automatically movable to its first unlocking position by the biasing spring in response to either or both exposure of the temperature responsive means to a temperature above a given threshold temperature and parting of the actuator cable.

In the presently preferred form of the improved latch, the latch member has a cylindrical cam portion with tapered ends. The locking means of the latch comprise detents, such as balls, which are engaged by the cam portion of the latch member and thereby extended to locking positions to lock the latch parts against disengagement when the latch member occupies its central locking position. Movement of the latch member to either unlocking position disengages its cam portion from the locking detents and thereby permits retraction of the detents to unlocking positions to release the latch parts for separation. The latched window grill is thereby released to open and in accordance with another feature of the invention is urged open by a spring.

According to yet a further feature of the invention, the latch spring and latch member are enclosed within the latch parts in such a way as to render the latch immune to tempering by children, and the various elements of the latch are constructed of corrosion resistant material, such as stainless steel. The latch is thereby rendered immune to degradation of the latch by the elements and remains very reliable in operation for prolonged periods of time without attention. The latch also locks automatically upon engagement of the latch parts by closing of the window grill and thereby encourages escape practice through the protected window. The latch actuator is positioned to be accessible to and designed to be readily recognizable and easily operable by all persons including the handicapped, children, and elderly.

DESCRIPTION OF THE PREFERRED EMBODIMENT

Figures 1, 2, 3, 4, 5, 6:
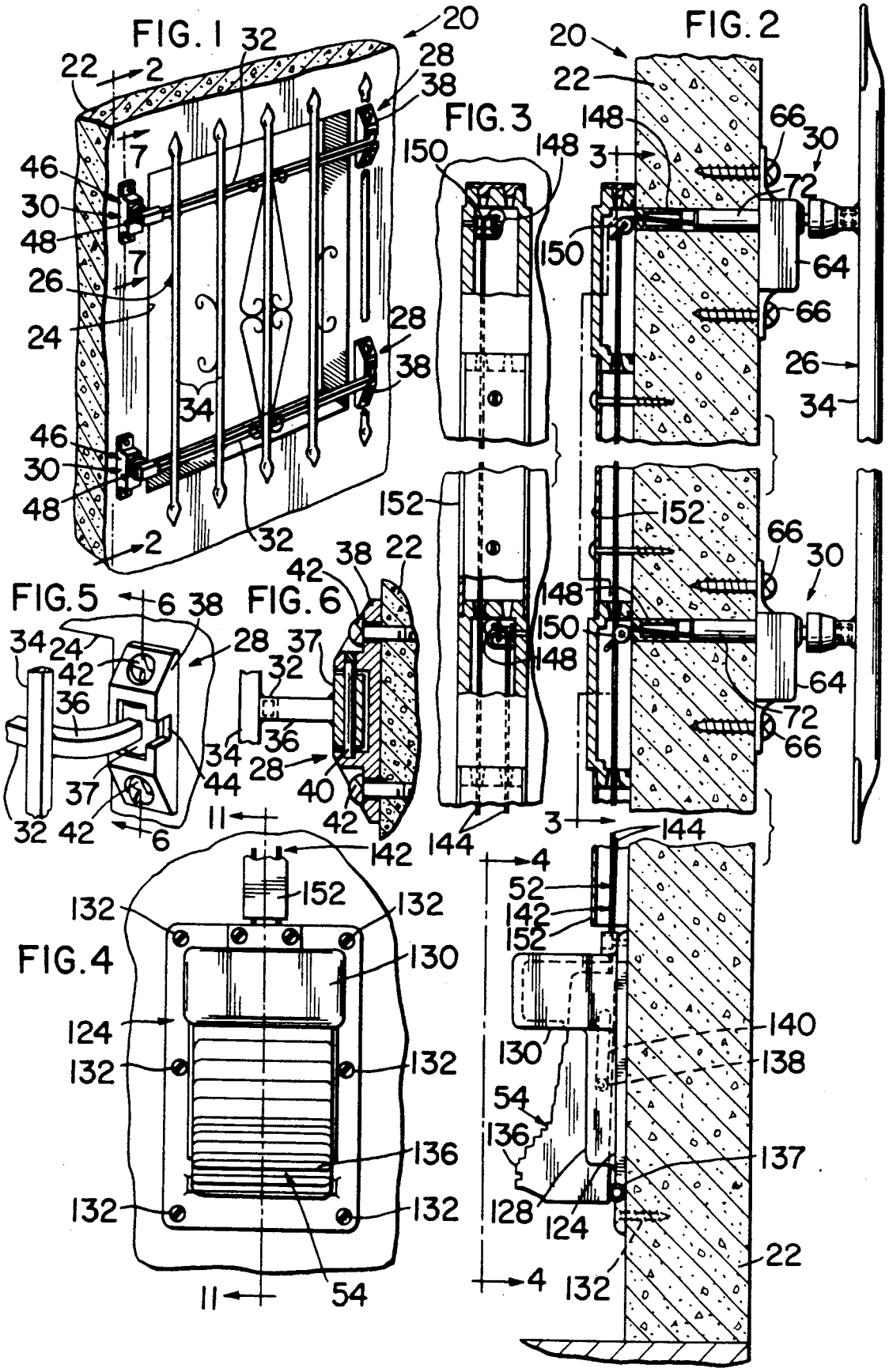
FIG. 1 is a fragmentary perspective view of a protective window grill installation equipped with a present improved latch for releasibly locking the grill in closed position.
FIG. 2 is an enlarged section taken on line 2—2 in FIG. 1.
FIG. 3 is a section taken on line 3—3 in FIG. 2.
FIG. 4 is a view looking in the direction of the arrows on the line 4—4 in FIG. 2.
FIG. 5 is a perspective view of one hinge which pivotably mounts the window grill for rotation between its open and closed positions.
FIG. 6 is a section taken on line 6—6 in FIG. 5.

Turning now to the drawings, there is illustrated in fragmentary fashion a building structure 20 having a wall 22 containing an opening 24 capable of use as an emergency escape opening through which persons can quickly exit the structure in the event of an emergency, such as a fire, and a security or protective closure 26 attached to the outside of the wall by hinges 28 for movement between a closed position shown in FIG. 1 and an open position. The particular opening 24 shown is a window, and the closure 26 is an ornamental wrought iron grill. Generally indicated at 30 are improved latches according to this invention for releasibly locking the grill 26 in its closed position wherein the grill spans the window 24 to prevent intruders from entering the structure 20 through the window. The latches are both manually releasible from the interior of the structure and automatically releasible in response to a fire or breaking of a latch cable to be described to release the grill for opening and permit escape from the structure through the window.

The wrought iron grill 26 is conventional and includes two horizontal bars 32 joined at intervals by vertical bars 34 which are welded to the horizontal bars. The spacing between the bars is made small enough and the bars made strong enough to prevent an intruder from squeezing between the bars. The right end portions 36 of the horizontal bars 32, as they are viewed in FIG. 1, are turned at right angles toward and attached by the hinges 28 to the wall 22. Alternately, instead of end portions 36 there may be utilized separate curved members (not shown) which fit into or about the ends of modified bars (not shown) which have no curved portions. These hinges comprise vertical hinge lugs 37 which are welded to the horizontal bar ends 36, pivotally disposed within hinge housings 38, and pivotally attached to the housings by hinge pins 40. The hinge housings 38 are rigidly attached to the wall 22 by non-removable fasteners 42. The hinge housings 38 are notched at 44 to permit the grill 26 to swing between its closed position of FIG. 1 and an open position wherein the grill extends outwardly from the wall 22 and thus uncovers the window 24.

The improved latches 30 of this invention releasibly secure the left ends of the horizontal grill bars 32, as the grill 26 is viewed in FIG. 1, to the structure wall 22. The two latches 30 are identical, and each comprises two latch parts 46 and 48 which are mounted on the wall 22 and grill 26, respectively. The latch parts occupy their engaged positions of FIG. 7 when the grill 26 is closed and to their disengaged positions of FIGS. 9 and 10 when the grill is open. The latch parts 46, 48 include coacting latch means 50 for releasibly locking the parts in their engaged positions of FIG. 7. When thus locked, the latches strongly resist forced disengagement of their parts and thereby also forced entry by intruders. In addition to the latch parts 46, 48 the improved latch 30 comprises actuating means 52 including a latch actuator 54 within the structure 20 which is manually operable to actuate the latch means 50 in such a way as to release the latch parts for separation. The latch actuator 54 is operatively connected to both latches 30 to simultaneously release both latches and thereby release the grill 26 for opening in response to manual operation of the actuator. Ejector springs 122 within the latches urge the released grill open.

According to important features of the invention, the latches 30 are uniquely constructed and arranged to assure their proper installation and to encourage escape practice by locking of the latches automatically when the grill 26 is closed. To these ends, the latch means 50 comprises a latch member 56 which is connected to the latch actuator 54 in a manner such that when the latch is properly installed, the latch member normally occupies a locking position, shown in FIG. 7. When the latch member occupies this locking position, the latch means 50 are conditioned to automatically lock the latch parts 46, 48 in their engaged positions in response to engagement of the parts. The latch member 56 is manually movable in one direction from its locking position to a first unlocking position by operation of the latch actuator 54 and in the opposite direction by spring action to a second unlocking position. In each unlocking position, the latch means 50 releases the latch parts for separation. If the latches are not properly installed, their latch members 56 will normally occupy one of their unlocking positions, and the grill 26 will not lock closed, thus alerting the latch installer to improper latch installation.

According to another important feature of the invention, the latch 30 includes a thermally responsive means 58 which releases the latch member 56 for movement to its second unlocking position by spring action in response to exposure of the thermally responsive means to a temperature above a given minimum temperature. This temperature is selected so that a fire in the vicinity of the latches 30 will release them and thereby release the grill 26 for opening.

Referring now in more detail to the drawings, the wall mounted latch part 46 comprises a housing 60 having an open normally inner side bounded by an outwardly directed flange 62 and an opposite normally outer wall 64. The housing flange 62 seats against outside of the building structure wall 22 and is secured to the wall by non-removable fasteners 66. In addition to the housing 60, the latch part 46 includes an inner guide assembly 68 for the latch member 56. This guide assembly includes a plate 70 which fits closely within and closes the open inner side of the latch housing 60 and seats against the outer side of the wall 22 and an integral tubular portion 72 which extends from the inner side of the plate 70 into a hole 74 drilled through the wall. The inner end of the tubular portion 72 is closed by a thick end wall 76. Fixed at its inner end to this end wall and extending coaxially through the tubular portion 72 is a guide rod 78. The opposite outer end of this rod extends through the latch housing 60 and coaxially partway through an opening 80 in the front housing wall 64. The opening 80 tapers radially outwardly toward the right hand end of the opening in FIG. 7. The latch housing wall 64 has an inner boss 82 surrounding the inner end of the opening 80 and an outer boss 84 surrounding the outer end of the opening. Fixed to the end of the inner boss 82 is a hardened washer-like face plate 86 containing a hole 87 coaxial with and of the same diameter as or slightly smaller than the smaller inner end of the opening 80.

Latch member 56 comprises a generally cylindrical body 88 containing a central bore slidably receiving the guide rod 78, whereby the latch member is slidable along the rod. At the inner end of the body 88 is an annular shoulder 90. At the outer end of the body 88 is a radially enlarged cylindrical cam 92 having a central cylindrical land 94 and tapered ends 96. Positioned on the latch member body 88 between its shoulder 90 and cam 92 is a washer 98 which seats against the shoulder. The outer diameter of this washer is larger than the diameter of the hole 87 in the hardened face plate 86.

Surrounding the guide rod 78 within the tubular portion 72 of the guide assembly 68 is a compression latch spring 100. The inner end of this spring seats against the end wall 76 of the tubular portion. The outer end of the spring seats against the inner end of the latch member 56 and urges the latch member outwardly toward the outer opening 80 in the latch housing 60 to a normal locking position shown in solid lines in FIG. 7 and in broken lines in FIG. 9.

The grill-mounted parts 48 of the two latches 30 are mounted on the free ends of the horizontal bars 32 of the grill 26, that is the horizontal bar ends opposite the grill hinges 28. Latch part 48 comprises a generally knob-shaped body 102 having a right angle socket portion 103 which slides over and is welded or otherwise non-removably fixed to the free end of its horizontal grill bar. A coaxial circular recess 104 enters the left side of the body as it is viewed in FIG. 7. Extending coaxially into the bottom of this recess is a bore 106. The recess 104 has an inner diameter slightly larger than the outer diameter of the outer boss 84 on the wall-mounted latch part 46 and a depth about equal to or slightly greater than the axial thickness of the latter boss. A tubular penetrator 108 has one end loosely positioned within the bore 106 and pivotally attached to the body 102 by a cross pin 110. The penetrator has an opposite open free end. The outside diameter of the penetrator is slightly less than the diameter of the hole 87 in the face plate 86 of the wall-mounted latch part 46. When the latch parts occupy their engaged positions of FIG. 7, the free end of the penetrator 108 extends coaxially through the opening 80 in the latch part 46, and the latch member 56 and its supporting guide rod 78 project into the open free end of the penetrator, as shown.

Loosely caged within radial bores 112 circumferentially spaced about the free end of the penetrator 108 are locking detents 114 in the form of hardened balls. These detents 114 are radially movable in their bores 112 between their extended locking positions of FIG. 7 and their retracted unlocking positions of FIGS. 9 and 10. When in their extended locking positions with the latch parts 46, 48 engaged as in FIG. 7, the detents 114 project radially outward beyond the outer surface of the penetrator 108 sufficiently to engage the edge of face plate 86 on the wall-mounted latch part 46 about the hole 87 in the face plate in such a way as to securely lock the latch parts against separation and the window grill 26 in its closed position. When in their retracted unlocking positions, the detents permit unrestricted passage of the penetrator 108 through the face plate 86 and thereby unrestricted separation and reengagement of the latch parts.

Figures 7, 8, 9, 10, 11, 12:
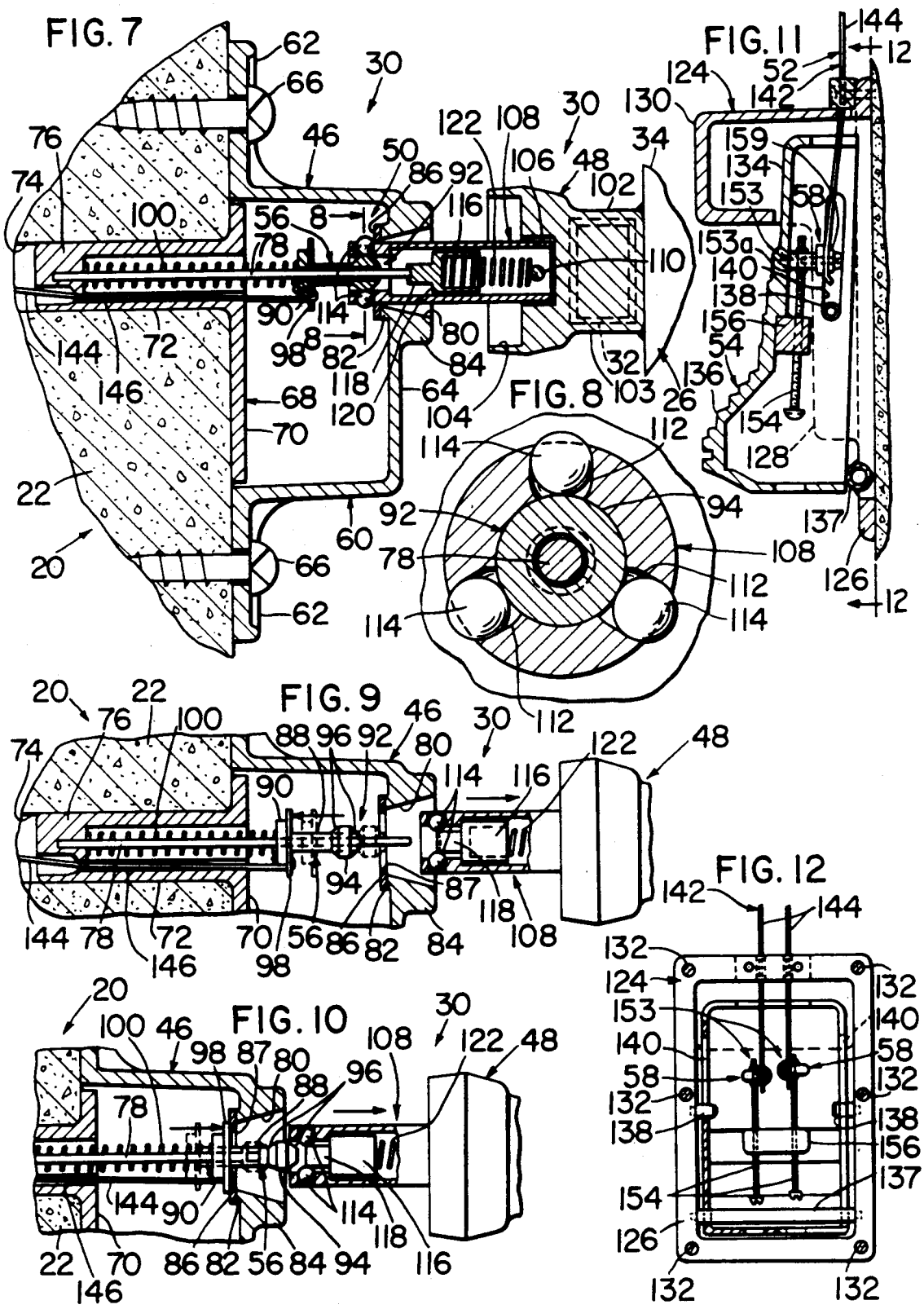
FIG. 7 is an enlarged vertical section taken on line 7—7 in FIG. 1 through a latch and showing the latch parts locked in their engaged positions.
FIG. 8 is an enlarged section taken on line 8—8 in FIG. 7.
FIG. 9 is a section similar to FIG. 7 showing the latch during manual release in response to operation of the latch actuator.
FIG. 10 is a section similar to FIG. 7 showing the latch during automatic release in response to a fire or breaking of the latch cable
FIG. 11 is an enlarged section taken on line 11—11 in FIG. 4.
FIG. 12 is a section taken on line 12—12 in FIG. 11.

The position of the latch member 56 illustrated in FIG. 7 is referred to herein as its locking position. In this locking position of the latch member, a plane passing through the axial midpoint of its cylindrical cam land 94 normal to the longitudinal axis of the latch member is located inwardly of the face plate 86 of the wall mounted latch part 46 (i.e. to the left of the face plate in FIG. 7) a distance approximately equal to the radii of the detent balls 114. The latch spring 100 urges the latch member 56 outwardly (to the right in FIG. 7) from this locking position. As will be explained presently, the latch actuating means 52 normally retains the latch member 56 in this locking position against the outward bias of the latch spring 100 and is manually operable to move the latch member inwardly (to the left in FIG. 7) from the locking position.

When the latch parts 46, 48 occupy their engaged positions of FIG. 7 and the latch member 56 occupies its locking position of that figure, the penetrator 108 of latch part 48 projects into the latch housing opening 80 in latch part 46 to a position where the detent balls 114 at the free end of the penetrator are located just inwardly of the face plate 86 on latch part 46. The latch member 56 and its supporting guide rod 78 projects into the open free end of the penetrator to a position where the land 94 of the cam 92 on the latch member is aligned with the detent balls 114. This land is radially sized to engage and retain the detent balls in their radially outer extended locking positions of FIG. 7 wherein they are disposed to engage the face plate 86 on the wall-mounted latch member and thereby securely lock the latch parts against separation. Slidable within the penetrator 108 is a plunger 116 having a reduced tip 118 adjacent the open free end of the penetrator and an axially facing shoulder 120 at the base of the tip. An ejector spring 122 urges the plunger 116 toward the free end of the penetrator. When the latch parts are engaged, the plunger 116 abuts the free end of the latch member guide rod 78 so that the plunger spring 122 urges the latch parts 46, 48 away from one another to their positions of FIG. 7 wherein the extended detent balls 114 engage the face plate 86.

As explained in more detail presently, the latch actuator 54 is operable to move or retract the latch actuator 56 inwardly from its locking position of FIG. 7, against the bias of its spring 100, to an unlocking position shown in solid lines in FIG. 9. In this unlocking position, cam 92 is withdrawn axially from engagement with the detent balls 114 to release the latter for inward movement to their retracted positions. This releases the latch parts for separation by the force of the compressed plunger spring 122 in latch part 48 acting against the guide rod 78 of latch part 46.

From the preceding description, it will be understood that the latch member 56, its guide rod 78 and latch spring 100, the detent balls 114, and the face plate 86 together comprise the coacting locking means 50 on the parts. It will also be understood that the latch member 56 has a central locking position and is movable in one axial direction from this locking position to a first unlocking position and in the opposite axial direction to a second unlocking position. When the latch parts 46, 48 are engaged with the latch member 56 in its locking position, the parts are locked against separation. The latch parts are released for separation or disengagement by movement of the latch member to either unlocking position. When thus released, the latch parts are separated by the plunger spring 122 in the part 48.

When the latch parts 46, 48 are separated or disengaged with the latch actuator 54 released, the latch member 56 is yieldably held by its latch spring 100 in its locking position shown in solid lines in FIG. 7 and broken lines in FIG. 9. During reengagement of the latch parts by relative movement of the parts toward one another, the latch penetrator 108 enters the latch opening 80, and the latch member 56 and its support rod 78 enter the open free end of the penetrator. Any of the detent balls 114 which project beyond the outer surface of the penetrator are forced radially inward by the tapered wall of the opening 80 to permit the penetrator to pass through the opening until the rod 78 engages and depresses the penetrator plunger 116, and the right hand tapered end 96 of the latch member cam 92 engages the inner sides of the detent balls. Continued movement of the penetrator through the opening 80 now causes the detent balls 114 to press against the right hand tapered end 96 of the cam 92 and retract the latch member 56 inwardly (to the left in the drawings) from its broken line locking position toward its solid line unlocking position of FIG. 9 against the thrust of the latch spring 100. This continues until the detent balls are located sufficiently inward of the face plate 86 to permit radial outward extension of the balls to their locking positions of FIG. 7 by the outward camming force exerted on the balls by the tapered end of the cam. At this point, the latch parts are freed for relative movement by the bias of their springs 100, 122 to their locked engaged positions of FIG. 7.

As noted earlier, the latch actuating means 52 includes a latch actuator 54 within the building structure 20. The illustrated preferred actuator is a pedal which a person may depress with his foot or hand. This pedal is mounted in a base 124 including an open rectangular frame 126 with upstanding side flanges 128 and a canopy-like formation 130 at one end. Base 124 is attached by screws 132 to the inside of the structure wall 22 directly below the two window grill latches 30 and near the floor with the base canopy 130 uppermost. The actuator pedal 54 has a generally tapered, hollow shell-like shape with a relatively flat end 134 and a relatively large tapered end 136. The outer surface of the tapered end 136 is serrated, as shown. The pedal 54 is disposed between the upstanding side flanges 128 of the pedal base 124 with the flat end 134 of the pedal uppermost and extending under the base canopy 130. The lower end of the pedal is slidably supported on a bearing member 137 rigid on the base. The pedal is secured to the base for endwise vertical movement relative to the base by aligned pins 138 which are rigid on the base flanges 128 and extend inwardly through longitudinal slots 140 in the side walls of the pedal.

The latch members 56 of the two window grill latches 30 are operatively connected to the actuator pedal 54 by adjustable connecting means 142 which are adjustable to properly locate the latch members 56 in their normal locking positions during installation of the latches. The connecting means 142 comprise two tension members 144, typically wire cables, extending between the latch members, respectively, and the latch actuating pedal 54. As shown best in FIGS. 2 and 7, the upper end of each cable 144 passes through the washer 98 and is secured to the inner shoulder 90 of the respective latch member 56. Each cable extends from its latch member inwardly through a longitudinal passage 146 in the tubular guide portion 72 of the corresponding latch part 46, then through the corresponding wall hole 74 and a guide sleeve 148 fixed within the inner end of the hole, then around a cable guide or pulley 150 mounted within a vertical protective channel strip 152 secured to the inner surface of the wall 22, then downwardly through this strip to the actuator pedal 54. The lower end of each cable 144 is secured to the pedal by an adjustable coupling 153.

Referring particularly to FIGS. 11 and 12, the adjustable coupling 153 for each cable 144 comprises a screw 154 extending lengthwise of the cable and threaded in a boss 156 within the pedal. The lower end of each cable 144 is secured by a fusible fire link, which constitutes the thermally responsive means 58 referred to earlier, to a member 153*a* rotatable on but restrained against movement along the respective screw 154. The screws 154 are thus rotatable to adjust the effective distance along each cable 144 between the actuator pedal 54 and the corresponding latch member 56. Fire links 58 are designed to fuse and thereby release the cables 144 from the latch actuating pedal 54 in response to exposure of the links to a temperature above a given minimum temperature which would occur in the event of a fire in the vicinity of the pedal, such as in the wall 22. If desired, the cable pulleys 150 may be constructed of the same fusible material as the fire links 58 so that the pulleys will fuse at an elevated temperature to effect automatic release of the latches 30 in the same way as the fire links. The elevated positions of such "fire link" pulleys is advantageous since heat rises.

This completes the structural description of the improved latch 30 of the invention. The operation of the latch will now be described. When initially installing the window grill 26 and its two latches 30, the adjustment screw 154 for each latch is adjusted to properly locate its latch member 56 in its locking position of FIG. 7. In this regard, it will be understood that adjustment of each screw 154 combined with the bias of the corresponding latch member spring 100 effects axial adjustment of the corresponding latch member to the right or to the left in FIG. 7, depending upon the direction of screw rotation, relative to the face plate 86 of latch part 46. If the latches are not properly installed and adjusted in this regard, the latches will not lock, thus alerting the latch installer to the improper installation/adjustment. The two adjusting screws provide sufficient independent adjustment of the two latches to assure proper adjustment of each latch. Assuming that the two latches 30 are properly installed and adjusted, they securely lock the window grill 26 in its closed position to prevent forced entry of an intruder into the structure 20 through the window 24.

In the event of an emergency, such as a fire, a person within the structure 20 can quickly and easily release the latches 30 and thereby release the window grill 26 for opening by pressing downward on the actuator pedal 54 either with a hand or a foot. This downward depression of the pedal retracts the latch members 56 of both latches 30 to the left in FIG. 7 from their locking positions of that figure to their solid line unlocking positions of FIG. 9 against the bias of the latch springs 100. The parts 46, 48 of both latches 30 are thereby released for separation, and the window grill 26 is released for opening. The grill is then urged open by the ejector springs 122. The actuator pedal is situated near the floor so that not only is it easily accessible to all, including children, the elderly, and handicapped, but also to persons who are forced to crawl or lie on the floor to breathe in a smoke-filled area. The pedal is preferably-painted a distinctive color so that it will be easily recognizable. The canopy 130 on the pedal base 124 functions as a shield which prevents an intruder from reaching between the grill bars and through the window and depressing the pedal with a stick or sprinkler valve operating rod.

If a fire occurs in the wall 22 or otherwise close to the actuator pedal 54, the heat of the flames will melt the fusible fire links 58 and/or fusible pulleys 150 to automatically release the latch members 56 for movement to the right in FIG. 7, through their broken line unlocking positions of FIG. 10, to the terminal positions of FIG. 10 by the bias of the latch springs 100. Latches 30 are thereby released, and the window grill 26 is opened by the latch springs 100. In this way, even if flames prevent persons within the structure 20 from reaching and operating the actuator pedal 54, the window grill 26 is automatically released and opened to provide firemen access to the structure through the window 24. Similarly, if either of the cables 144 breaks or separates from the actuator pedal 54 or the corresponding latch member 56, that latch member is urged to the position of FIG. 10 by its latch spring 100 to release the corresponding latch. Accordingly, each latch member is "fail-safe" in the event of this latter malfunctioning.

The various elements of the latches 30 are preferably made of non-corrodible materials, preferably stainless steel where appropriate, to assure proper operation of the latches over prolonged periods of time without servicing of or attention to the latches. The latches are easy to operate and thus encourage practicing emergency escape through the window. Another important feature of the invention resides in the fact that the latch elements most susceptible to damage, such as the latch springs 100, ejector springs 122 and latch member 56 are enclosed within the latch parts 46, 48 and are thus protected. Because of this, the latches 30 are also relatively immune to tampering, particularly by children.

Thus there has been shown and described a novel quick release latch mechanism which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor's claim:

1. A latch comprising:

first and second latch parts movable relative to one another between engaged and disengaged positions, and coacting latch means on said parts for releasibly locking said parts in said engaged positions, including a latch member on one part having a locking position wherein said parts are locked against disengagement and movable in one direction from said locking position to a first unlocking position and in the opposite direction from said locking position to a second unlocking position, and locking means on the other part which are positionable by said latch member in a first position wherein said locking means are engagable with said one part to lock said parts against disengagement by movement of said latch member to said locking position when said parts occupy said engaged positions and are released for movement to a second position wherein said parts are released for disengagement upon movement of said latch member to either unlocking position.

2. A latch comprising:

first and second latch parts movable relative to one another between engaged and disengaged positions, coacting latch means on said parts for releasibly locking said parts in said engaged positions including a latch member on one part having a locking position wherein said parts are locked against separation and movable in one direction from said locking position to a first unlocking position wherein said parts are released for separation and in the opposite direction from said locking position to a second unlocking position wherein said parts are released for separation, and wherein said parts are relatively movable along an axis between said engaged and disengaged positions, said latch member is movable in opposite directions along said axis between said locking and unlocking positions, said latch further comprises detent means on one part which are positionable laterally of said axis in an extended position by said latch member upon movement of said latch member to said locking position and are movable to a retracted position upon movement of said latch member to either unlocking position, and said detent means when in said extended position are disposed to lock said parts against disengagement and when in said retracted position are disposed to release said parts for disengagement.

3. A latch comprising:

first and second latch parts movable relative to one another between engaged and disengaged positions, coacting latch means on said parts for releasibly locking said parts in said engaged positions including a latch member on one part having a locking position wherein said parts are locked against disengagement and movable in one direction from said locking position to a first unlocking position wherein said parts are released for disengagement and in the opposite direction from said locking position to a second unlocking position wherein said parts are released for disengagement, and wherein said parts are relatively movable along an axis between said engaged and disengaged positions, said latch member extends longitudinally of and is movable along said axis between said locking and unlocking positions and comprises a coaxial cylindrical cam, the other latch part comprises a tubular part which coaxially surrounds said cam when said parts occupy their engaged positions, and said one latch part coaxially surrounds said tubular part when said parts occupy their engaged positions, said latch further comprises detent means on said tubular part movable radially outward to extended positions wherein the detent means are disposed for locking engagement with said one part to lock said parts against disengagement and movable radially inward to retracted positions wherein the detent means are disposed to release said parts for disengagement and reengagement, and said cam has a cylindrical land with tapered ends which engages said detent means to position the detent means in said extended position and thereby lock said parts against disengagement upon movement of said latch member to its locking position when said parts occupy their engaged positions, and said detent means are released for retraction to release said parts for separation upon axial movement of said latch member from its locking position to either unlocking position.

4. A latch according to claim 1 including:

a spring urging said latch member to one of said unlocking positions, and latch actuating means for normally retaining said latch member in said locking position against the bias of said spring and for moving said latch member to the other unlocking position.

5. A latch comprising:

first and second latch parts movable relative to one another between engaged and disengaged positions, coacting latch means on said parts for releasibly locking said parts in said engaged positions including a latch member on one part having a locking position wherein said parts are locked against disengagement and movable in one direction from said locking position to a first unlocking position wherein said parts are released for disengagement and in the opposite direction from said locking position to a second unlocking position wherein said parts are released for disengagement, a spring urging said latch member to one of said unlocking positions, and latch actuating means for normally retaining said latch member in said locking position against the bias of said spring and for moving said latch member to the other unlocking position comprising thermally responsive means which releases said latch member for movement by said spring to said one unlocking position in response to exposure of said thermally responsive means to a temperature above a given temperature.

6. A latch comprising:

first and second latch parts movable relative to one another between engaged and disengaged positions, coacting latch means on said parts for releasibly locking said parts in said engaged positions including a latch member on one part having a locking position wherein said parts are locked against disengagement and movable in one direction from said locking position to a first unlocking position wherein said parts are released for disengagement and in the opposite direction from said locking position to a second unlocking position wherein said parts are released for disengagement, a spring urging said latch member to one of said unlocking positions, latch actuating means for normally retaining said latch member in said locking position against the bias of said spring and for moving said latch member to the other unlocking position comprising a latch actuator, means including a flexible tension member and a fusible link connecting said actuator to said latch member, whereby said latch member is movable to said other unlocking position against the bias of said spring by movement of said actuator in one direction and said actuator is movable in the opposite direction by said spring, and means limiting movement of said actuator in said opposite direction by said spring to a normal position wherein said latch member is located in said locking position, and wherein said fusible link fuses to release said latch member for movement by said spring to said one unlocking position in response to exposure of said fusible link to a temperature above a given temperature.

7. A latch according to claim 3 including:

a spring urging said latch member to one of said unlocking positions, latch actuating means for normally retaining said latch member in said locking position against the bias of said spring and moving said latch member to the other unlocking position against the bias of said spring comprising a latch actuator, means including a flexible tension member and a fusible link connecting said actuator to said latch member, whereby said latch member is movable to said other unlocking position against the bias of said spring by movement of said actuator in one direction and said actuator is movable in the opposite direction by said spring, and means for limiting movement of said actuator in said opposite direction by said spring to a normal position wherein said latch member is located in its locking position, and wherein said fusible link fuses to release said latch member for movement by said spring to said one unlocking position in response to exposure of said fusible element to a temperature above a given temperature.

8. A heat responsive latch comprising:

first and second latch parts movable relative to one another between engaged and disengaged positions, coacting latch means on said parts for releasibly locking said parts in their engaged positions, thermally responsive means for releasing said latch means to release said parts for relative movement to their disengaged positions in response to exposure of said thermal responsive means to a temperature above a given temperature, and wherein said coacting latch means comprises a latch member movable between a locking position wherein said latch means secures said parts in said engaged positions and an unlocking position wherein said latch means releases said parts for disengagement, and a spring for urging said latch member to said unlocking position, and said thermally responsive means comprises a fusible link which normally secures said latch member in said locking position against the bias of said spring and which fuses to release said latch member for movement to said unlocking position by said spring in response to exposure of said fusible link to a temperature above said given threshold temperature.

9. A latch according to claim 8 wherein:

said parts are relatively movable along an axis between said engaged and disengaged positions, said latch member is movable along said axis between said locking and unlocking positions, said coacting latch means further comprises detent means on one part movable laterally of said axis to extended positions wherein the detent means are disposed for locking engagement with said other part to lock said parts against disengagement and to retracted positions wherein the detent means are disposed to release said parts for disengagement and reengagement, and said latch member effects extension of said detent means to lock said parts against disengagement upon movement of said latch member to its locking position when said parts occupy their engaged positions, and said latch member permits retraction of said detent means to release said parts for separation upon axial movement of said latch member from its locking position to said unlocking position.

10. A latch comprising:

first and second latch parts movable relative to one another between engaged and disengaged positions, coacting latch means on said parts for releasibly locking said parts in their engaged positions comprising a latch member movable between a locking position wherein said latch means secures said parts in said engaged positions and an unlocking position wherein said latch means releases said parts for disengagement, thermally responsive means for releasing said latch means to release said parts for relative movement to their diengaged positions in response to exposure of said thermal responsive means to a temperature above a given temperature, and wherein said parts are relatively movable along an axis between said engaged and disengaged positions, said latch member is movable along said axis between said locking and unlocking positions and comprises a coaxial cylindrical cam, one latch part comprises a tubular part which coaxially surrounds said cam, and the other latch part coaxially surrounds said tubular part when said parts occupy their engaged positions, said latch means further comprises detent means on said tubular part movable radially outward to extended positions wherein the detent means are disposed for locking engagement with said other part to lock said parts against disengagement and movable radially inward to retracted positions wherein the detent means are disposed to release said parts for disengagement and reengagement, and said cam has a cylindrical land with tapered ends which engages said detent means to position the detent means in their extended positions and lock said parts against disengagement upon movement of said latch member to its locking position when said parts occupy their engaged positions and which releases said detent means for retraction of the detent means to release said parts for disengagement upon axial movement of said latch member from said locking position to said unlocking position.

11. A latch comprising:

a first tubular latch part having a longitudinal axis and an open end, a second latch part having an opening on said axis for receiving said open end of said first part, and said latch parts being movable relative to one another along said axis toward one another to engaged positions wherein said open end of said first part extends into said second part through said opening in said second part and away from one another to disengaged positions wherein said first part is withdrawn from said opening in said second part, coacting latch means on said parts including a latch member on one part movable between locking and unlocking positions when said parts occupy said engaged positions to effect locking of said parts in said engaged positions and release of said parts for disengagement, a spring contained within one part for separating said parts upon release of said parts for disengagement by movement of said latch member to said unlocking position, and wherein said latch member and spring are totally enclosed within and shielded by their respective containing members in both said engaged and disengaged positions.

12. A latch according to claim 11 wherein:

said latch means includes a support member within the latch part not containing said spring which supports said latch member for movement between its locking and unlocking positions and which extends along said axis into the part containing said spring when said parts occupy said engaged positions, and said spring extends along said axis and is compressed between said support member and said part containing the spring when said parts occupy said engaged positions.

13. A latch according to claim 12 wherein:

said support member is mounted within said second part and comprises a rod extending along said axis and having one end fixed to said second part and its other end disposed within said end opening in said second part for extension of said other rod end into said open end of said first part when said parts are engaged, said spring is mounted within said first part and is compressed between said first part and said rod when said parts are engaged for urging said parts to said disengaged positions when the parts are released for disengagement, said locking means comprises detent means at said open end of said first part extendable radially outward into locking relation with said second part when said parts are engaged to lock said parts against disengagement and retractable radially inward to release said parts for disengagement, said latch member comprises a cam and is slidable on said rod between said locking and unlocking positions, and said cam engages said detent means and cams the detent means outwardly into locking relation with said second part to lock said parts agains disengagement upon movement of said latch member to said locking position with said parts engaged, and said cam releases said detent means for inward retraction to release said parts for disengagement upon movement of said latch member to said unlocking position.

14. A latch according to claim 13 wherein:

movement of said latch member from said locking position to said unlocking position occurs in a first direction along and toward said fixed end of said rod, and said latch member is movable in the opposite direction along said rod from said locking position to a second unlocking position wherein said cam releases said detent means for inward retraction to release said parts for disengagement, and said latch means includes a second spring within said second part urging said latch member in said opposite direction along said rod, and said latch includes actuating means for moving said latch member in said first direction.

15. A latch according to claim 14 wherein:

said detent means comprise detents circumferentially about said first part, said cam has tapered ends and an intervening cylindrical land which engages and extends said detents outwardly into locking engaement with said second part when said latch member occupies its locking position, and said latch member permits inward retraction of said detents to release said parts for separation when said latch member occupies said unlocking positions, respectively.

16. A latch according to claim 15 wherein:

said latch actuating means comprises a base to be secured to a support, a latch actuator mounted on said base for movement relative to the base, a flexible tension member connecting said actuator and said cam, whereby said actuator occupies a given normal position relative to said base when said latch member occupies its locking position, and said latch member is movable from its locking position to its first unlocking position by movement of said actuator relative to said base in one direction from said normal position, and said actuator is urged in the opposite direction from said normal position by the bias of said second spring, means for restraining said actuator against movement in said opposite direction from said normal position, and means for adjusting said latch member relative to said actuator lengthwise of said tension member.

17. In combination:

a structure having a fire escape opening to the exterior of the structure, and a protective closure mounted on the structure for movement between a closed position wherein the closure overlies said opening and an open position wherein the closure perits persons to exit the structure through the opening, a latch for releasibly locking said closure in its closed position including manually operable means within said structure for releasing said latch to release said closure for opening, and thermally fusible means for releasing said latch to release said closure for opening in response to exposure of said thermal responsive means to a temperature above a given temperature, and wherein said latch further includes a latch member having a locking position wherein said latch is conditioned to lock said closure in said closed position and movable in opposite directions from said locking position to first and second unlocking positions wherein said latch is conditioned to release said closure for opening, and a spring urging said latch member from said locking position to one unlocking position, said manually operable means comprises a latch actuator within said structure, a tension member joining said actuator and latch member, whereby said actuator occupies a given normal position when said latch member occupies its locking position and said latch member is movable from said locking position to its other unlocking position against the bias of said spring by movement of said actuator in one direction from said normal position, and stop means for restraining said actuator against movement in said one direction from said normal position by the bias of said spring, and said thermally fusible means comprises a fusible link in series with said tension member.

18. In combination:

a structure having a fire escape opening to the exterior of the structure, and a protective closure mounted on the structure for movement between a closed position wherein the closure overlies said opening and an open position wherein the closure perits persons to exit the structure through the opening, a latch releasible from the interior of said structure for releasibly locking said closure in its closed position comprising first and second latch parts mounted on said structure and closure, respectively, for relative movement to engaged positions upon movement of said closure to its closed position and to disengaged positions upon opening movement of said closure, and wherein said latch includes a latch member on said first part having a central locking position and movable in one direction from said locking position to a first unlocking position and in the opposite direction from said locking position to a second unlocking position, locking means on one part engagable with said latch member and with the other part when said parts occupy their engaged positions for releasibly locking said parts in their engaged positions and thereby locking said closure in its closed position when said latch member occupies its central locking position and releasing said parts for relative movement to their disengaged positions upon movement of said latch member from said locking position to either unlocking position, and latch actuating means accessible within said structure for manually moving said latch member to one unlocking position thereof.

19. The combination according to claim 18 wherein said latch further includes a spring urging said latch member toward its other unlocking position, and said latch actuating means comprises a latch actuator within said structure and a tension member connecting said actuator and said latch member, whereby said actuator occupies a given normal position when said latch member occupies its locking position and said actuator is urged in one direction from said normal position by the bias of said spring and is movable in the opposite direction from said normal position against the bias of said spring to release said latch, and means for restraining said actuator against movement in said one direction from said normal position by the bias of said spring.

20. In combination:

a structure having a fire escape opening to the exterior of the structure, and a protective closure mounted on the exterior of the structure for movement between a closed position wherein the closure overlies said opening and an open position, a latch comprising two latch parts secured to said structure and closure, respectively, including a first hollow elongate latch part having a longitudinal axis and an open end, a second hollow latch part having an opening on said axis for receiving said open end of said first latch part, and said latch parts being movable relative to one another along said axis during opening and closing movement of said closure and toward one another to engaged positions wherein said open end of said first part extends into said second part through said opening in said second part upon movement of said closure to its closed position and away from one another to disengaged positions wherein said open end of said first part is withdrawn from said opening in said second part upon movement of said closure to its open position, coacting latch means on said parts for releasibly locking said parts in their engaged positions and thereby locking said closure its closed position including a latch member on one part extending along said axis and through both parts when said parts occupy their engaged positions and moveable along said axis between a locking position wherein said parts are locked in their engaged positions and an unlocking position wherein said parts are released for relative movement to their disengaged positions, means for yieldably retaining said latch member in its locking position, means accessible within said structure for manually moving said latch member to its unlocking position, and a spring fixed within the other part and engaging said latch member when said parts are locked in their engaged positions for urging said parts to their disengaged positions and thereby said closure toward its open position upon release said parts for relative movement to their disengaged positions by movement of said latch member to its unlocking position.

21. A latch comprising:

first and second latch parts movable relative to one another between engaged and disengaged positions, coacting latch means on said parts for releasibly locking said parts in said engaged positions including a latch member on one part having a locking position wherein said parts are locked against disengagement and movable in one direction from said locking position to an unlocking position wherein said parts are released for disengagement, and a spring on said one part urging said latch member toward said locking position, latch actuating means including a latch actuator and connecting means including a flexible tension member connecting said latch member and actuator for movement of said latch member from said locking position to said unlocking position by movement of said actuator in one direction, and wherein said latch member is movable by said spring in the opposite direction from said locking position to a second unlocking position wherein said parts are released for disengagement in the event of a break in said connecting means.

22. A latch according to claim 21 wherein:

said connecting means includes a fusible fire link in series with said tension member.

23. A latch comprising:

first and second latch parts movable relative to one another between engaged and disengaged positions, coating latch means on said parts for releasibly locking said parts in said engaged positions including a latch member on one part having a locking position wherein said latch member is disposed to lock said parts against disengagement and movable along an axis between said locking position and an unlocking position wherein said parts are released for disengagement, latch actuating means including a latch actuator and connecting means joining said latch member and actuator for movement of said latch member from said locking position to said unlocking position by movement of said actuator in one direction, and wherein said connecting means includes means for adjusting said latch member along said axis independently of the position of said actuator.

24. A latch comprising:

a first tubular latch part having a tubular wall, a longitudinal axis, and an oen end, a second latch part having an opening on said axis for receiving said open end of said first part, and said latch parts being movable relative to one another along said axis toward one another to engaged positions wherein said open end of said first part extends into said second part through said opening in said second part and away from one another to disengaged positions wherein said first part is withdrawn from said opening in said second part, detent means movable radially in the wall of said tubular latch part between an extended position wherein said detent means are disposed to engage the edge of said opening in said first part and therbe lock said parts against disengagement when said latch parts occupy said engaged positions and a retracted position wherein said detent means are disposed to permit disengagement and reengagement of the parts, and a latch member in said second latch part movable on said axis when said parts occupy said engaged positions and between a locking position wherein said latch member extends into said tubular part and retains said detent means in their extended position and an unlocking position wherein said latch member releases said detent means for movement to their retracted position.

25. A latch according to claim 24 wherein:

said latch member comprises a cylindrical cam with tapered ends movable along said axis between said locking and unlocking positions.

26. A latch according to claim 25 including:

a spring acting between said second latch part and said latch member urging said latch member to said locking position, and means connected to said latch member for moving said latch member from said locking position to said unlocking position against the bias of said spring.

27. A latch comprising:

first and second latch parts movable relative to one another between engaged and disengaged positions, coacting latch means on said parts for releasibly locking said parts in said engaged positions including a latch member on one part having a locking position wherein said parts are locked against disengagement and movable in one direction from said locking position to an unlocking position wherein said parts are released for disengagement, and a spring on said one part urging said latch member toward said locking position, latch actuating means including a latch actuator and connecting means connecting said latch member and actuator for movement of said latch member from said locking position to said unlocking position by movement of said actuator in one direction, and wherein said latch member is movable by said spring in the opposite direction from said locking position to a second unlocking position wherein said parts are released for disengagement in response to a break in said connecting means.

* * * * *